US007735695B2

(12) United States Patent
Ikushima

(10) Patent No.: US 7,735,695 B2
(45) Date of Patent: Jun. 15, 2010

(54) LIQUID MATERIAL DELIVERING METHOD AND DEVICE THEREFOR

(75) Inventor: Kazumasa Ikushima, Mitaka (JP)

(73) Assignee: Musashi Engineering, Inc., Mitaka-shi, Tokyo (JP)

( * ) Notice: Subject to any disclaimer, the term of this patent is extended or adjusted under 35 U.S.C. 154(b) by 622 days.

(21) Appl. No.: 10/492,837

(22) PCT Filed: Oct. 16, 2002

(86) PCT No.: PCT/JP02/10738

§ 371 (c)(1),
(2), (4) Date: Oct. 21, 2004

(87) PCT Pub. No.: WO03/033168

PCT Pub. Date: Apr. 24, 2003

(65) Prior Publication Data

US 2005/0067438 A1 Mar. 31, 2005

(30) Foreign Application Priority Data

Oct. 17, 2001 (JP) ..... 2001-319074

(51) Int. Cl.
*B67D 5/42* (2006.01)

(52) U.S. Cl. ..... 222/333; 222/1; 222/309; 222/380; 222/422

(58) Field of Classification Search ..... 222/333, 222/380, 481.5, 63, 309, 422, 1
See application file for complete search history.

(56) References Cited

U.S. PATENT DOCUMENTS 3,337,096 A * 8/1967 Brown ..... 222/380
4,229,413 A * 10/1980 Marteau d'Autry ..... 222/380
4,861,340 A 8/1989 Smith et al.
5,205,439 A * 4/1993 Sturm ..... 222/1
5,671,873 A * 9/1997 Hammerl et al. ..... 222/309
5,765,729 A * 6/1998 Miller et al. ..... 222/380
6,092,691 A * 7/2000 Schuerholz et al. ..... 222/1

(Continued)

FOREIGN PATENT DOCUMENTS

JP 61-185569 11/1986

(Continued)

OTHER PUBLICATIONS

European Search Report dated Mar. 26, 2008 of EP 02801578.

*Primary Examiner*—J. Casimer Jacyna
(74) *Attorney, Agent, or Firm*—Westerman, Hattori, Daniels & Adrian, LLP

(57) ABSTRACT

A liquid delivering method and a liquid delivering device are provided, which solve the prior art problems including damages to a plunger and a valve seat. A liquid material delivering method includes the steps of advancing at high speed a liquid material delivering plunger with its distal end surface closely contacted with the liquid material, and subsequently abruptly stopping plunger driving means, thereby applying an inertial force to the liquid material to deliver the latter. A liquid delivering device includes a tubular metering section, a plunger internally contacting the metering section, a nozzle having a delivery port, a first valve for establishing communication between the metering section and the nozzle, a storage container for storing a liquid material, a liquid material feed valve (second valve) for establishing communication between the storage container and the metering section.

19 Claims, 2 Drawing Sheets

U.S. PATENT DOCUMENTS

| | | | |
|---|---|---|---|
| 6,138,720 | A | 10/2000 | Zigler |
| 6,267,266 | B1 | 7/2001 | Smith et al. |
| 6,715,506 | B1 | 4/2004 | Ikushima |

FOREIGN PATENT DOCUMENTS

| | | |
|---|---|---|
| JP | 6-57461 | 8/1994 |
| JP | 2001-113212 | 4/2001 |
| WO | WO 00/40346 | 7/2000 |

* cited by examiner

LIQUID MATERIAL DELIVERING METHOD AND DEVICE THEREFOR

TECHNICAL FIELD

The present invention relates to the field in which a liquid material is delivered in a fixed amount through a nozzle delivery port by dripping or ejection in the form of flying droplets, and to the technique for delivering a liquid material at high accuracy in a clean state while preventing damages to components.

BACKGROUND ART

A known technique for ejecting a liquid material in the form of flying droplets employs a retracting and advancing plunger. The plunger is quickly accelerated to advance and then abruptly stopped by abutting it against a valve seat. Upon the abrupt stop, an inertial force is applied to the liquid material present in front of the plunger, thus causing the liquid material to eject in the form of flying droplets under the action of the inertial force.

DISCLOSURE OF THE INVENTION

With such a known device, however, because the inertial force required for ejecting a liquid material in the form of flying droplets is obtained by abutting a moving solid plunger against a stationary solid valve seat and momentarily stopping the movement of the plunger, there arise problems that the plunger and the valve seat are seriously damaged by the abutting, and damaged plungers and valve seats must be frequently exchanged. Another problem is that a damaged member or the like is mixed into the liquid material to melt therein. In particular, when the delivered liquid material is a functional material, the mixing and melting of the damaged member may often disable the functional effect specific to the liquid material.

Accordingly, an object of the present invention is to provide a liquid delivering method and a liquid delivering device, which solve the prior art problems by abruptly stopping a plunger having been quickly accelerated to advance without abutting the plunger against a valve seat.

To achieve the above object, the delivering method according to the present invention is featured in comprising the steps of advancing at high speed a liquid material delivering plunger with a plunger's distal end surface closely contacted with the liquid material, and subsequently abruptly stopping plunger driving means, thereby applying an inertial force to the liquid material to deliver the liquid material.

Also, the delivering method according to the present invention is featured in comprising the steps of intermittently advancing a liquid material delivering plunger with a plunger's distal end surface closely contacted with the liquid material, thereby intermittently applying an inertial force to the liquid material held in a tubular metering section to continuously deliver the liquid material.

To achieve the above object, the delivering device according to the present invention is featured in comprising a tubular metering section, a plunger internally contacting the metering section, a nozzle having a delivery port, a first valve for establishing communication between the metering section and the nozzle, a storage container for storing a liquid material, a second valve for establishing communication between the storage container and the metering section, wherein the inner diameter of the metering section is substantially equal to the diameter of a through hole formed in a valve member of the first valve.

In addition to the above-described construction, the delivering device of the present invention selectively includes one or more of the features that the storage container is under pressure applied from pressurizing means, that the plunger includes an air bubble purging mechanism, that the metering section has a communication hole communicating with the storage container, and the diameter of the communication hole is much smaller than the inner diameter of the metering section, that the inner diameter of a delivery port of the nozzle is smaller than the inner diameters of the metering section and the first valve, that the delivery port of the nozzle and the surface of the plunger contacting the liquid material under pressure are opposed to each other, that the delivering device further comprises a controller for controlling the first valve, the second valve, the pressurizing means, and the driving means.

Moreover, the plunger used in the delivering device according to the present invention is featured in comprising a plunger rod having a tubular portion formed with an air bubble purging hole opened to an outer wall surface of the plunger rod, a plunger head having a communication hole formed at the center thereof to be communicated with the tubular portion of the plunger rod, and including a seal portion projecting on the outer wall surface of the plunger rod to be closely contacted with an inner wall surface of the metering section, and a valve rod inserted in the tubular portion of the plunger rod, wherein when one end of the valve rod is pressed, the other end of the valve rod is brought into close contact with the plunger head.

Operation

By quickly accelerating the plunger to advance and then abruptly stopping the plunger so as to apply a great inertial force to the liquid material, the liquid material in the metering section is ejected to fly in the form of small droplets while the amount of the ejected liquid droplets is controlled depending on, e.g., the moving speed of the plunger and the distance of movement of the plunger.

Also, by operating the plunger to be quickly accelerated to advance and then abruptly stopped, the liquid material filled in the tubular metering section is given with an inertial force, whereby the liquid droplets are delivered through a tip of the nozzle. The delivering operation is carried out by delivering the liquid material, which has been filled in the metering section by each filling operation, through the steps of quickly accelerating the plunger to advance and then abruptly stopping it, which are repeated plural times.

Alternatively, the liquid material filled in the metering section by each filling operation can also be ejected in the form of flying droplets at a time with proper adjustment of the moving speed of the plunger and the distance of movement of the plunger.

In order to eject the liquid material in the form of flying droplets, therefore, an acceleration, i.e., a speed difference, applied to the plunger is important. The plunger must be moved at high speed by initial acceleration and then abruptly stopped. The plunger is controlled by the plunger driving means in such a manner. Increasing the plunger speed up to a level necessary for ejecting the liquid material in the form of flying droplets requires a distance for acceleration through which the plunger is accelerated to a certain level.

Note that the amount of the ejected liquid droplets is dependent on the distance of movement of the plunger, but if the distance of movement of the plunger is set to be short depending on the amount of the ejected liquid droplets, the plunger speed required for ejecting the liquid material in the form of flying droplets cannot be obtained. Based on the relationship between the amount of the ejected liquid droplets and the moving speed of the plunger, therefore, specifications of the metering section and the plunger are decided so that the distance of movement of the plunger sufficient to provide the required plunger speed is obtained.

Further, to reduce the amount of the ejected liquid droplets, it is needed to shorten the stroke (distance of movement) of the plunger. On the other hand, the stroke (distance of movement) of the plunger must be increased from the viewpoint of obtaining the plunger speed sufficient to eject the liquid material in the form of flying droplets. In order to satisfy those contradictory demands at the same time, the metering section is designed to be relatively thin so that the distance of movement of the plunger is ensured which provides the plunger speed sufficient to eject the liquid material in the form of flying droplets. Also, with the thinning of the metering section, the volume produced by the movement of the plunger, i.e., the amount of the ejected liquid droplets, can be reduced even when the plunger is moved over a relatively large stroke.

BRIEF DESCRIPTION OF THE DRAWINGS

FIG. 1 is a general view of a liquid delivering device in which; FIG. 1(*a*) is a front view and FIG. 1(*b*) is a side view.

BEST MODE FOR CARRYING OUT THE INVENTION

Figure 1:
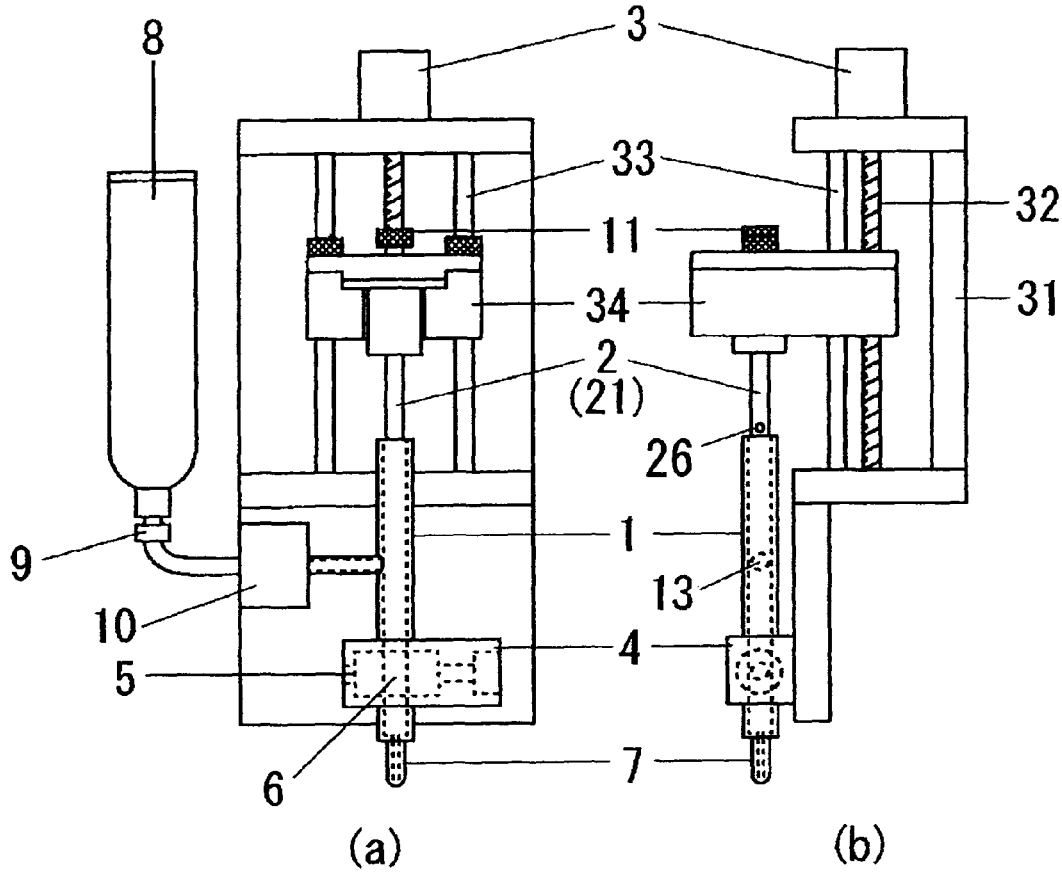
Figure 2:
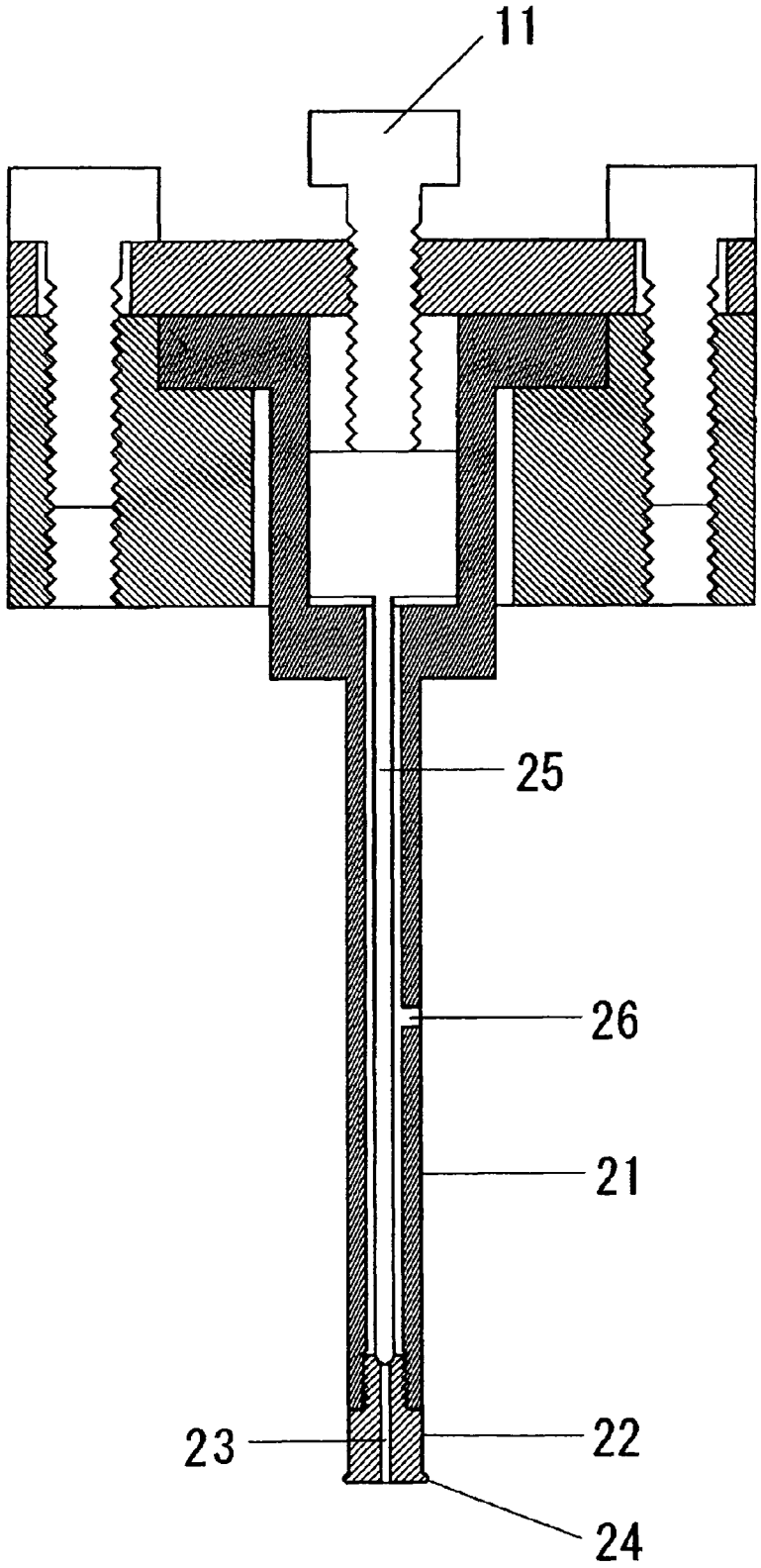
FIG. 2 is an enlarged view of a principal part of the liquid delivering device.

To explain the delivering method of the present invention in more detail, it comprises a first step of bringing a distal end surface of a liquid material delivering plunger into close contact with the liquid material, a second step of advancing the plunger at high speed, and a third step of abruptly stopping the plunger. The first step is performed at the time of initial setup or when trapping of air bubbles is confirmed. In most cases, the delivering operation is performed by repeating the second step and the third step. During the process of repeating the second step and the third step, because the distal end surface of the plunger is held in a state closely contacting the liquid material, the operation of "bringing the distal end surface of the plunger into close contact with the liquid material" is not performed unlike the first step.

To explain the delivering device of the present invention in more detail, it comprises a tubular metering section, a plunger internally contacting the metering section, moving means for displacing a position of the plunger, a nozzle having a delivery port, a first valve for establishing communication between the metering section and the nozzle, a storage container for storing a liquid material, and a second valve for establishing communication between the storage container and the metering section. In order to efficiently transmit a pressure change of the liquid material generated with the plunger operation to a nozzle tip, the inner diameter of the first valve and the inner diameter of the metering section are set substantially equal to each other so that the resistance in the tubular section is reduced.

The expression "substantially" used here represents the allowable range of inner diameter difference between the valve and the metering section within which liquid droplets can be satisfactorily delivered through a nozzle end under a pressure transmitted through the liquid material with the movement of the plunger, and does not mean the inner diameter difference between the valve and the metering section at which the liquid droplets cannot be satisfactorily formed.

Preferably, the delivery port of the nozzle and the liquid contact surface of the plunger are disposed in positions opposed to each other. After retracting the plunger, the liquid material is filled into the metering section from the storage container filled with the liquid material. Depending on the kind of liquid material, the liquid material is preferably filled into the metering section while pressuring the liquid material in the storage container by a pressurizing means.

The metering section has a communication hole communicating with the storage container. The diameter of the communication hole is preferably much smaller than the inner diameter of the tubular section to minimize inflow of the pressure in the metering section into the storage container during the delivering operation so that the applied pressure can be utilized as a delivery pressure without loss.

Further, the inner diameter of the delivery port of the nozzle is preferably smaller than the inner diameter of the metering section and the inner diameter of the delivery valve (first valve).

It is desired that no air bubbles be trapped in the liquid material filled into the metering section from the storage container. To this end, the plunger is provided with a mechanism for purging the air bubbles from the metering section to the exterior.

More specifically, the plunger comprises a plunger rod having a tubular portion formed with an air bubble purging hole opened to an outer wall surface of the plunger rod, a plunger head coaxially fitted to a tip of the plunger rod, and including a seal portion projecting on the outer wall surface of the plunger rod to be closely contacted with an inner wall surface of the metering section, and a valve rod inserted in the tubular portion of the plunger rod. When one end of the valve rod is pressed, the other end of the valve rod is brought into close contact with the plunger head.

The diameter of the communication hole formed in the metering section and communicating with the storage container preferably smaller than the inner diameter of the metering section. More preferably, the diameter of the communication hole is very small.

The applied pressure should be transmitted to only the nozzle, but it is also transmitted to the storage container side through the communication hole. The smaller the diameter of the communication hole, the larger is flow resistance of the liquid material. Therefore, the proportion of the pressure transmitted to the nozzle side is increased as the diameter of the communication hole decreases.

Further, the inner diameter of the delivery port of the nozzle is preferably smaller than the inner diameters of the metering section and the inner diameter of the first valve.

In addition, the first valve, the second valve, the pressurizing means, and the driving means can be all controlled by a controller.

It is to be noted that the present invention will be described in more detail below in connection with an embodiment, but the present invention is limited in no way by the following embodiment.

<<Overall Structure>>

In FIG. 1, reference numeral 31 denotes a frame comprising an upper frame and a lower frame. The upper frame supports thereon a pair of guide rods 33, 33 for guiding a plunger support 34 in the vertical direction, and a screw shaft 32 rotated by a motor 3, which is mounted at the top of the frame 31, and moving the plunger support 34 in the vertical direction. The lower frame supports thereon a delivery valve (first valve) 4, a liquid material feed valve (second valve) 10, and a metering section 1 through the delivery valve (first valve) 4.

<<Delivery Section (Pump)>>

Within the metering section 1 formed of a tubular member, a plunger 2 is disposed in a state closely contacting an inner surface of the metering section 1 such that it is vertically movable with vertical movement of the plunger support 34. The delivery valve (first valve) 4 is disposed at a distal end of the metering section 1, and a nozzle 7 is disposed on the other side of the delivery valve (first valve) 4 opposite to the metering section side. The inner diameter of a flow passage 6 formed in a valve member 5 of the delivery valve (first valve) 4 is substantially equal to the inner diameter of the metering section 1 so that, when the delivery valve (first valve) 4 is in its open position, the liquid material smoothly flows into the delivery valve (first valve) 4 from the metering section 1.

In this embodiment, the delivery valve (first valve) 4 is constituted as a rotary valve capable of selectively taking one of two positions, i.e., an open position for communicating the metering section 1 and the nozzle 7 with each other, and a closed position for cutting off the communication between them. However, a slide valve may also be used if the diameter of the flow passage is equal to the inner diameter of the metering section 1.

<<Storage Container>>

One end of a pipe is connected to an outer wall of the metering section 1 in its central portion. The metering section 1 and the pipe are communicated with each other through a hole 26 having a diameter much smaller than the inner diameter of the metering section 1.

The other end of the pipe is communicated a storage container 8, and the liquid material feed valve (second valve) 10 is disposed between the pipe 9 and the storage container 8. The liquid material feed valve (second valve) 10 is capable of selectively taking one of two positions, i.e., an open position for communicating the metering section 1 and the storage container 8 with each other, and a closed position for cutting off the communication between them. Further, the storage container 8 is detachable from the delivering device at a storage container connector 9 disposed between the liquid material feed valve (second valve) 10 and the storage container 8.

<<Purging of Air Bubbles>>

The plunger 2 is provided with an air bubble purging mechanism.

More specifically, the plunger 2 comprises a plunger rod 21 having a tubular portion formed with an air bubble purging hole 26 opened to an outer wall surface of the plunger rod, a plunger head 22 fitted to a tip of the plunger rod 21, having a air bubble purging hole 23 formed at its center to be communicated with the tubular portion of the plunger rod 21, and including a seal portion 24 projecting on the outer wall surface of the plunger rod to be closely contacted with an inner wall surface of the metering section, and a valve rod 25 inserted in the tubular portion of the plunger rod 21.

The plunger rod 21 has an upper portion formed as a larger-diameter tubular portion, and also has a flange formed at the top thereof. The plunger rod 21 is fixed to the plunger support 34 with the aid of the flange.

An upper larger-diameter portion of the valve rod 25 is slidably fitted in the larger-diameter tubular portion of the plunger rod 21, and a set screw 11 meshing with the plunger support 34 is held in abutment against the upper larger-diameter portion of the valve rod 25. Usually, one end of the valve rod 25 is pressed by the set screw 11, and the other end of the valve rod 25 is brought into close contact with the plunger head 22.

<<Air Bubble Purging Operation>>

When the set screw 11 is loosened, the valve rod 25 is allowed to move in the lengthwise direction of the plunger rod 25. In this state, when the valve rod 25 is brought into abutment against the set screw 11, the valve rod 25 and the plunger head 22 are apart from each other, thereby opening the air bubble purging hole 23 formed in the plunger head 22. Accordingly, the air bubble purging hole 23 is communicated with the air bubble purging hole 26 of the plunger rod 21 via a gap formed between the plunger rod 25 and the plunger head 22, and hence communicated with the exterior.

Thus, by loosening the set screw 11, the plunger head 22 can be communicated with the exterior through the plunger rod 21 and the air bubble purging hole 26, and air bubbles can be purged from the plunger rod 21 to the exterior via a purge route thus formed.

The liquid material delivering operation using the liquid material delivering device having the above-described construction will be described below.

<<Filling of Liquid Material>>

The storage container 8 filled with the liquid material is connected to the storage container connector 9. At this time, the plunger 2 is advanced to a position near the hole 13 but not beyond the hole 13 toward the nozzle side.

The liquid material feed valve (second valve) 10 is brought into the open position to communicate the storage container 8 and the metering section 1 with each other. Subsequently, when the plunger 2 is retracted, the liquid material in the storage container 8 is caused to flow into the metering section 1 through the liquid material feed valve (second valve) 10. At this time, air having been so far present in the pipe between the storage container 8 and the metering section 1 is first filled into the metering section 1, and the liquid material flows into the metering section 1 following the air.

<<Purging of Air Bubbles>>

The gas having flown into the metering section 1 during the above-mentioned step must be removed because a pressure response becomes poor due to compressibility of the gas.

To that end, the liquid material feed valve (second valve) 10 is brought into the closed position, the set screw 11 is loosened, and the plunger 2 is advanced. Because the plunger rod 21 as a constituent member of the plunger 2 is coupled to a driving mechanism, it is also advanced in interlink with the driving mechanism. On the other hand, the valve rod 25 is fixedly coupled to the plunger rod 21 by the set screw 11. With the loosening of the set screw 11, therefore, the valve rod 25 starts to advance only after abutting against the set screw 11 (because of the valve rod 25 being so far in a free state) in spite of the driving mechanism operating the plunger to advance. As a result, the valve rod 25 is held apart away from the plunger head 22 to communicate the plunger rod 21 and the air bubble purring hole 26 with each other.

When the plunger 2 is further advanced, the pressure of the liquid material in the metering section 1 rises. Because liquid having smaller specific gravity than gas is collected in an upper portion of the metering section 1, the air within the metering section 1 is purged to the exterior through the plunger rod 21 and then the air bubble purging hole 26. After the air has all been purged out, the set screw 11 for the plunger 2 is tightened so that the tip of the valve rod 25 comes into close contact with the plunger head 22 to cut off the communication between the plunger rod 21 and the air bubble purging hole 23. The air bubble purging operation is thereby brought to an end.

The above description is made in connection with the air bubble purging operation performed at the start of the delivering operation. Even during the delivering operation, however, when trapping of air bubbles in the metering section is confirmed, the air bubbles can be likewise purged out through the steps of loosening the set screw 11, closing the delivery valve, and advancing the plunger. After the air bubble purging operation, the delivering operation can be promptly resumed by tightening the set screw 11 and opening the delivery valve.

<<Filling of Liquid Material>>

In this state, there are no air bubbles trapped in the liquid material filled in the metering section 1.

Now, the liquid material feed valve (second valve) 10 is set to the open position again, and the plunger 2 is retracted to fill a desired amount of the liquid material in the metering section 1. After that, the liquid material feed valve (second valve) 10 is returned to the closed position.

<<Delivery of Liquid Material>>

The liquid material is delivered by setting the delivery valve (first valve) 4 to the open position and advancing the plunger 2 through a stroke corresponding to the desired amount of the delivered liquid material. Here, the stroke through which the plunger 2 is to be advanced can be calculated depending on the desired amount of the delivered liquid material and the inner diameter of the metering section 1.

The operation of advancing the plunger 2 is performed as follows. After quickly accelerating the plunger 2, the plunger driving means is abruptly stopped to quickly slow down and then stop the movement of the plunger 2 without abutting it against a valve seat. With such movement, i.e., quick acceleration and abrupt stop, of the plunger 2, the liquid material in the metering section 1 is given with an inertial force and is delivered through the tip of the nozzle 7. With the inertial force increasing to a certain level, the liquid material is forced to eject in the form of flying droplets.

Here, since the inner diameter of the metering section 1 and the inner diameter of the delivery valve (first valve) 4 are substantially equal to each other, the pressure loss is small and the forces applied to the liquid material can be utilized for delivering the liquid material.

After the plunger 2 has been moved to the lowermost end, the delivery valve (first valve) 4 is returned to the closed position, and the liquid material feed valve (second valve) 10 is set to the open position again, followed by retracting the plunger 2 to feed the liquid material. On that occasion, a pressurizing means may be connected to the storage container 8 so as to pressurize the liquid material in the storage container 8 for promotion of inflow of the liquid material into the metering section 1.

Thus, the delivering operation is carried out by repeating the steps of sucking the liquid material into the metering section 1 from the storage container 8 and delivering the liquid material in the metering section 1 through the nozzle 7. The liquid material introduced to the metering section 1 can be delivered in plural times until the liquid material in the metering section 1 is exhausted. Taking into account workability including, e.g., the size of a workpiece to which the liquid material is delivered, a proper amount of the liquid material to be introduced to the metering section 1 can be decided case by case.

Additionally, the above-described plunger mechanism serves as an air bubble purging mechanism effective in the case of delivering any kind of liquid material by operating a plunger in a liquid-tight manner, and its applications are not limited to the delivering device of the type described above.

INDUSTRIAL APPLICABILITY

According to the present invention thus constructed, since the liquid material is forced to eject in the form of flying droplets with the advance of the plunger, the plunger rod is no longer required to be abutted against a valve seat, and the members for applying forces necessary for ejecting the liquid material in the form of flying droplets can be prevented from being damaged. Therefore, a damaged member is avoided from mixing into the liquid material to melt therein, and the liquid material can be delivered in a clean state. Also, since damages due to abutting of the plunger rod against the valve seat are prevented, it is possible to reduce exchange frequency of the members.

Further, because of no pressure loss, the liquid material can be delivered at high accuracy. In particular, since the applied pressure is transmitted to the liquid material without even a slight pressure loss, a very small amount of the liquid material can also be delivered at high accuracy.

Since air bubbles present in the liquid material to be delivered are purged out, the distal end surface of the plunger can be closely contacted with the liquid material so that the movement of the plunger is precisely transmitted to the liquid material. It is hence possible to deliver the liquid material at high accuracy and prevent air bubbles from mixing in the delivered liquid droplets.

The invention claimed is:

1. A liquid material delivering method comprising the steps of:

providing a liquid material delivering device comprising:

a nozzle having a delivery port directed downward;

a metering section having a tubular space in communication with said nozzle;

a flow passage communicating said metering section with said nozzle;

a liquid material storage container in communication with the nozzle; and a liquid material delivering plunger having a seal portion and a plunger rod, the seal portion being provided on the plunger rod such that the seal portion slides while closely contacting with an inner wall surface of the tubular space of said metering section; and carrying out an operation, the operation comprising the steps of:

filling the metering section with an amount of a liquid material to be delivered in the operation, the liquid material being supplied from the liquid material storage container;

advancing said plunger rod at high speed;

abruptly stopping the plunger rod after the step of advancing; and repeating plural times the steps of advancing and stopping, such that the amount of the liquid material in a single filling step is delivered in the form of flying droplets.

2. A liquid material delivering method according to claim 1, wherein the plunger rod is advanced and stopped by a driving mechanism comprising a screw shaft for moving the plunger in the vertical direction and a motor for rotating the screw shaft.

3. A liquid material delivering method according to claim 1, wherein said flow passage is shaped approximately along a straight line.

4. A liquid material delivering method according to claim 1, further comprising a valve for establishing communication between said metering section and said nozzle, the valve disposed in the said flow passage.

5. A liquid material delivering method according to claim 4, wherein said flow passage is formed in a valve member of said valve.

6. A liquid material delivering method according to claim 5, wherein an inner diameter of said flow passage is substantially equal to that of said metering section.

7. A liquid material delivering device comprising:

a storage container for storing a liquid material;

a metering section having a tubular space in communication with said storage container;

a plunger including a plunger rod and a seal portion wider than said plunger rod which slides while closely contacting with an inner wall surface of the tubular space of said metering section;

a nozzle having a delivery port directed downward;

a first flow passage communicating said metering section with said nozzle;

a first valve for establishing communication between said metering section and said nozzle, the first valve disposed in the first flow passage; and a liquid material feed valve disposed in a flow passage communicating a hole of said metering section with said liquid material storage container, wherein an amount of a liquid material filling the metering section in a single filling step is delivered in the form of flying droplets by repeating plural times a step of advancing said plunger at high speed and subsequently abruptly stopping the plunger.

8. A liquid delivering device according to claim 7, wherein the inner diameter of said metering section is substantially equal to the diameter of a through hole formed in a valve member of said first valve.

9. A liquid delivering device according to claim 8, wherein said storage container is under pressure applied from pressurizing device.

10. A liquid delivering device according to claim 7, wherein said plunger includes an air bubble purging mechanism.

11. A liquid delivering device according to claim 7, wherein said metering section has a communication hole communicating with said storage container, and the diameter of said communication hole is much smaller than the inner diameter of said tubular space.

12. A liquid delivering device according to claim 7, wherein the inner diameter of the delivery port of said nozzle is smaller than the inner diameters of said metering section and said first valve.

13. A liquid delivering device according to claim 7, wherein the delivery port of said nozzle and the surface of said plunger contacting the liquid material under pressure are opposed to each other.

14. A liquid delivering device according to claim 7, further comprising a controller for controlling said first valve, said second valve, said pressurizing device, and said driving mechanism.

15. A liquid delivering device according to claim 10, wherein said air bubble purging mechanism has a tubular portion, and said tubular portion is constituted by a plunger comprising a plunger rod having an air bubble purging hole opened to an outer wall surface of said plunger rod, a plunger head fitted to a tip of said plunger rod, having a communication hole formed at the center thereof to be communicated with a tubular portion of said plunger rod, and including a seal portion projecting on an outer wall surface of said plunger head to be closely contacted with an inner wall surface of said metering section, and a valve rod inserted in the tubular portion of said plunger rod, wherein when one end of said valve rod is pressed, the other end of said valve rod is brought into close contact with said plunger head.

16. A liquid material delivering device according to claim 7, further comprising a driving means for advancing the plunger at high speed and subsequently abruptly stopping the plunger, wherein the driving means comprises a screw shaft for moving the plunger in the vertical direction and a motor for rotating the screw shaft.

17. A liquid delivering device according to claim 7, wherein said first flow passage is shaped approximately along a straight line.

18. A liquid material delivering device according to claim 7, wherein said first flow passage is formed in a valve member of said first valve.

19. A liquid material delivering device according to claim 18, wherein an inner diameter of said first flow passage is substantially equal to that of said metering section.

* * * * *